US012435534B1

(12) United States Patent
Pollock

(10) Patent No.: US 12,435,534 B1
(45) Date of Patent: Oct. 7, 2025

(54) PORTABLE SHADE SYSTEM

(71) Applicant: Adam John Pollock, Lakeside, CA (US)

(72) Inventor: Adam John Pollock, Lakeside, CA (US)

( * ) Notice: Subject to any disclaimer, the term of this patent is extended or adjusted under 35 U.S.C. 154(b) by 261 days.

(21) Appl. No.: 18/448,912

(22) Filed: Aug. 12, 2023

Related U.S. Application Data

(60) Provisional application No. 63/373,616, filed on Aug. 26, 2022.

(51) Int. Cl.
*E04H 15/50* (2006.01)
*E04H 15/02* (2006.01)
*E04H 15/48* (2006.01)

(52) U.S. Cl.
CPC ..... *E04H 15/50* (2013.01); *E04H 15/02* (2013.01); *E04H 15/48* (2013.01)

(58) Field of Classification Search
CPC ..... E04H 15/50
See application file for complete search history.

(56) References Cited

U.S. PATENT DOCUMENTS 4,580,375 A * 4/1986 Nodskov ..... G09F 15/0068 52/109
5,263,507 A * 11/1993 Chuang ..... E04H 15/48 135/912
5,626,362 A * 5/1997 Mottola ..... G09B 9/04 280/80.1
5,632,293 A * 5/1997 Carter ..... E04H 15/50 135/145
7,520,290 B2 * 4/2009 Dalbo ..... E04H 15/50 135/145
7,604,212 B2 * 10/2009 Tsai ..... E04H 15/50 52/109
10,253,523 B2 * 4/2019 Volin ..... E04H 15/50
11,293,197 B2 * 4/2022 Goldszer ..... E04H 15/46
11,434,656 B2 * 9/2022 Yang ..... E04H 15/505
12,320,139 B2 * 6/2025 Yang ..... E04H 15/32
2002/0074032 A1 * 6/2002 Park ..... E04H 15/50 135/131
2010/0006131 A1 * 1/2010 Liu ..... E04H 15/50 135/143
2016/0060896 A1 * 3/2016 Toohey ..... E04H 15/32 135/120.1
2022/0412117 A1 * 12/2022 Yan ..... E04H 15/64

OTHER PUBLICATIONS

Adam John Pollock, "Bigfoot Shade," Facebook, Sep. 12, 2021, https://www.facebook.com/Bigfootshade, USA (More details p. 2).

* cited by examiner

*Primary Examiner* — Noah Chandler Hawk
(74) *Attorney, Agent, or Firm* — Ted Masters

(57) ABSTRACT

A portable shade system that can be wheeled in both the collapsed and deployed states, consisting of a swivel caster wheel for each canopy leg. The wheels are connected to plates that are secured to the bottom of the canopy legs. A series of breakaway connectors between the plates and wheels combined with the ability to lock the caster rotation of the two primary wheels provides the structural rigidity needed for the portable shade system to roll on two wheels similar to a dolly. A storage case with an open bottom design is pulled over the collapsed canopy and secured around the breakaway connectors. The case features one or more handles used to push or pull the portable shade system.

8 Claims, 5 Drawing Sheets

PORTABLE SHADE SYSTEM

CROSS REFERENCE TO RELATED APPLICATION

This application claims the filing benefit under 35 U.S.C. § 119 (e) of U.S. Provisional Application No. 63/373,616 filed Aug. 26, 2022 which is hereby incorporated by reference.

FIELD OF THE INVENTION

The present invention relates to portable shade canopies, a popular outdoor product that typically consists of a collapsible metal frame and a fabric roof. Portable shade canopies offer a convenient way for consumers to shelter themselves from the sun and elements at sporting events, camping, tailgating and other outdoor activities.

BACKGROUND OF THE INVENTION

10'×10' is the most common deployed size of a portable shade canopy and they are available in a variety of different sizes. When folded into the collapsed state for storage and transport the canopy is intended to be placed into a storage case. Canopy storage cases are commonly fully enclosed rectangular fabric bags with a zipper closure that may also include roller wheels.

Portable shade canopies are intended to be easily transported to and from where they will be utilized. This commonly means moving the canopy in the collapsed state from a vehicle to the location where it will be deployed, such as the spectator area at a sports field. However even in the collapsed state canopies occupy a significant amount of space and are cumbersome to carry due to their weight and size.

Canopy manufacturers have attempted to address this by adding wheels to the storage cases. These wheels tend to be small and inadequate. As an example, when pulled across terrain such as dirt these wheels often fail to roll. This is counterproductive and adds unwanted drag and friction.

Additionally, since these wheels are part of the storage case, the canopy must be in the case to utilize them. It can be a frustrating and time-consuming process to get a collapsed canopy into a fully enclosed storage case. This also means these wheels cannot be used while deploying the canopy or while the canopy is in the deployed state.

Because of the deficiencies of wheels on today's storage cases consumers will often resort to either carrying the canopy or placing it into a wagon. Carrying the full weight of the canopy in your arms has obvious disadvantages and is not practical or convenient.

While wagons are an ideal method of transporting the canopy, it presents a major drawback. A wagon that is transporting a shade canopy now has most of its cargo space consumed by it. This reduces the wagon's ability to transport other important items.

Also, when a shade canopy is deployed there is often a need to move it a short distance. An example is at youth sporting events where a first game is completed at one field then the next game takes place at an adjacent field. In this case it is preferred not to collapse the canopy just to redeploy it a short distance away.

There is no convenient way to move a deployed shade canopy. A common sight at youth sporting events is seeing four people collectively lifting each of the four canopy legs to walk it to the next location.

Therefore, a need exists for a portable shade system that can be wheeled in the collapsed state using wheels integrated with the canopy itself, rather than wheels attached to the storage case.

A need also exists for the ability to wheel and easily move a portable shade system in the deployed state.

Furthermore, a need also exists for a storage case that operates with a wheeled portable shade system that can be easily applied and removed.

SUMMARY OF THE INVENTION

A portable shade system having a deployed and collapsed state. A canopy supported by four canopy legs with four wheels, one wheel disposed at the bottom of each leg.

Each wheel is carried by a fork. All wheels have the ability to caster rotate freely in any direction. Caster rotation is defined as the ability to swivel the wheel to any heading throughout 360 degrees. Caster rotation is a separate and independent motion from the rolling of the wheel.

Each wheel is mounted to a plate which is then secured to a canopy leg. Two of the wheels are to be known as primary, while the other two are secondary.

A total of three breakaway connectors span the plates as well as the primary wheel forks. Each breakaway connector has a together and separated position. Each breakaway connector consists of a cooperating smaller tube and a larger tube which are secured together with a spring button. The spring button allows the user to separate the cooperating tubes as well as secure them together with a "click."

All three breakaway connectors are to be in the together position when the portable shade system is in the collapsed state. When the breakaway connectors are in the together position they form a rigid structure between the plates and wheels.

Two caster rotation lock mechanisms, one for each primary wheel, serve to lock the caster rotation of the primary wheels at a fixed heading using a pin which engages with the respective fork. The caster rotation lock mechanisms can be engaged or disengaged by the user. The caster rotation lock mechanisms are to be engaged when the portable shade system is in the collapsed state.

A storage case is shaped and dimensioned to fit over the canopy and canopy legs in the collapsed state. The storage case has an open bottom end and is pulled over the canopy like a sock and tightened by zipping a case zipper. A case strap is configured to run under two of the breakaway connectors and is secured with a strap latch. This makes a secure connection between the storage case and the breakaway connectors which allows the portable shade system to be pushed or pulled using a case handle without the case coming off.

To wheel the portable shade system in the collapsed state, the storage case is applied, the three breakaway connectors are placed in the together position and both caster rotation locks are engaged. Now the portable shade system can be wheeled in a similar fashion to a dolly where it is leaned back on the two primary wheels with the other two wheels off the ground. The portable shade system can then be pushed or pulled across terrain using the handle on the storage case. Additionally, when on hard and level terrain the portable shade system can be pushed or pulled in the upright state where all four wheels are on the ground.

If attempting to roll a portable shade system on wheels like a dolly without the rigidity of the breakaway connectors combined with the caster rotation locks, it becomes unbalanced, leans to one side and can eventually roll over.

Conversely, with the breakaway connectors in the together position, and with the caster rotation lock mechanisms engaged, the portable shade system now has the needed structural support to be wheeled in a balanced and stable state. It is this novel combination that encompasses the essence of the portable shade system.

To deploy the portable shade system from the collapsed state, the storage case is first removed then both caster rotation lock mechanisms are disengaged. Next, the breakaway connectors are separated. Now the user can walk one canopy leg outward with its wheel rolling on the ground which slowly unfolds and expands the portable shade system to its full size. The canopy legs are then extended vertically to their full height and the portable shade system is now in the deployed state.

To return to the collapsed state, these steps are simply done in reverse order. The portable shade system can be wheeled in the deployed state as well as the collapsed state.

Additionally, each wheel also has an independent braking mechanism that can prevent the portable shade system from unintended rolling in both the deployed and collapsed states.

Other embodiments, in addition to the embodiments enumerated above will become apparent from the following detailed description taken in conjunction with the accompanying illustrations of a portable shade system.

BRIEF DESCRIPTION OF THE DRAWINGS

FIG. 2 depicts an enlarged perspective view of the portable shade system in the collapsed state with the storage case on;

DETAILED DESCRIPTION OF THE INVENTION

Figure 1:
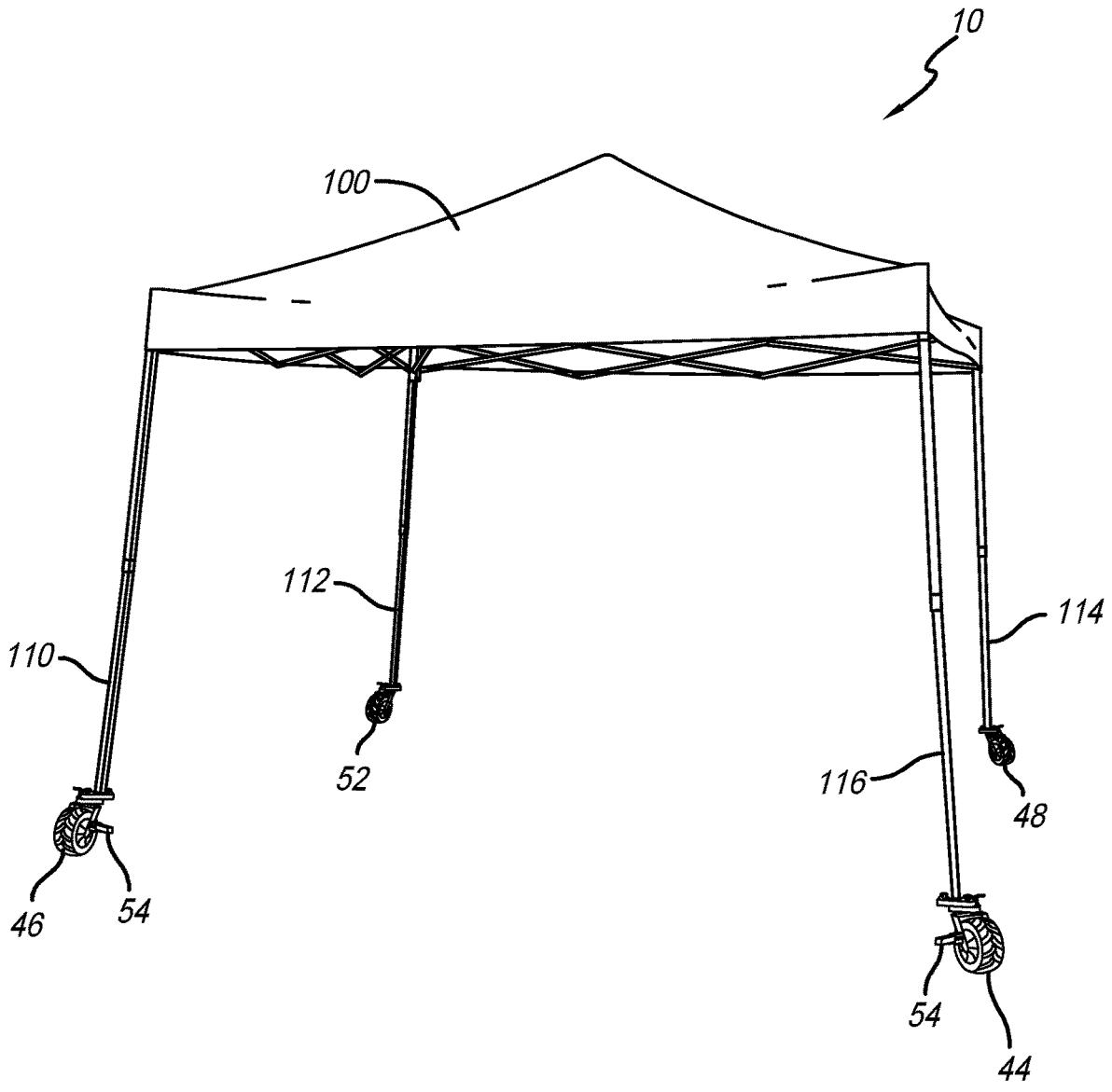
FIG. 1 is a perspective view of the preferred embodiment of the portable shade system in the deployed state.

Referring initially to FIG. 1 which shows the portable shade system 10 in a deployed state. A canopy 100 is supported by four canopy legs 110, 112, 114 and 116. Four wheels 44, 46, 48 and 52, one wheel disposed at the bottom of each canopy leg.

Figure 2:
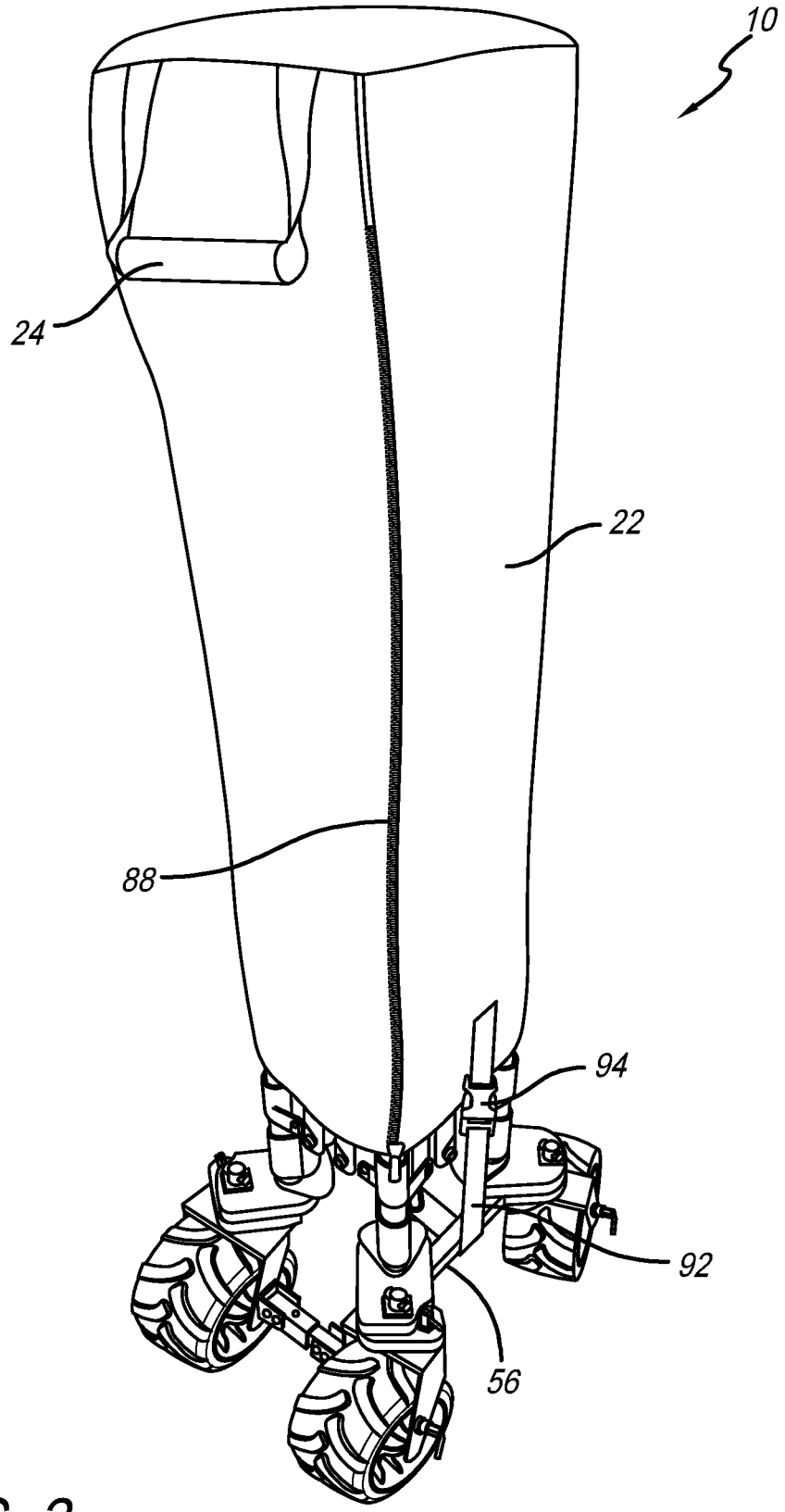

FIG. 2 shows the portable shade system 10 in a collapsed state. The portable shade system 10 can be wheeled by the user in both the collapsed and deployed states.

Figure 3:
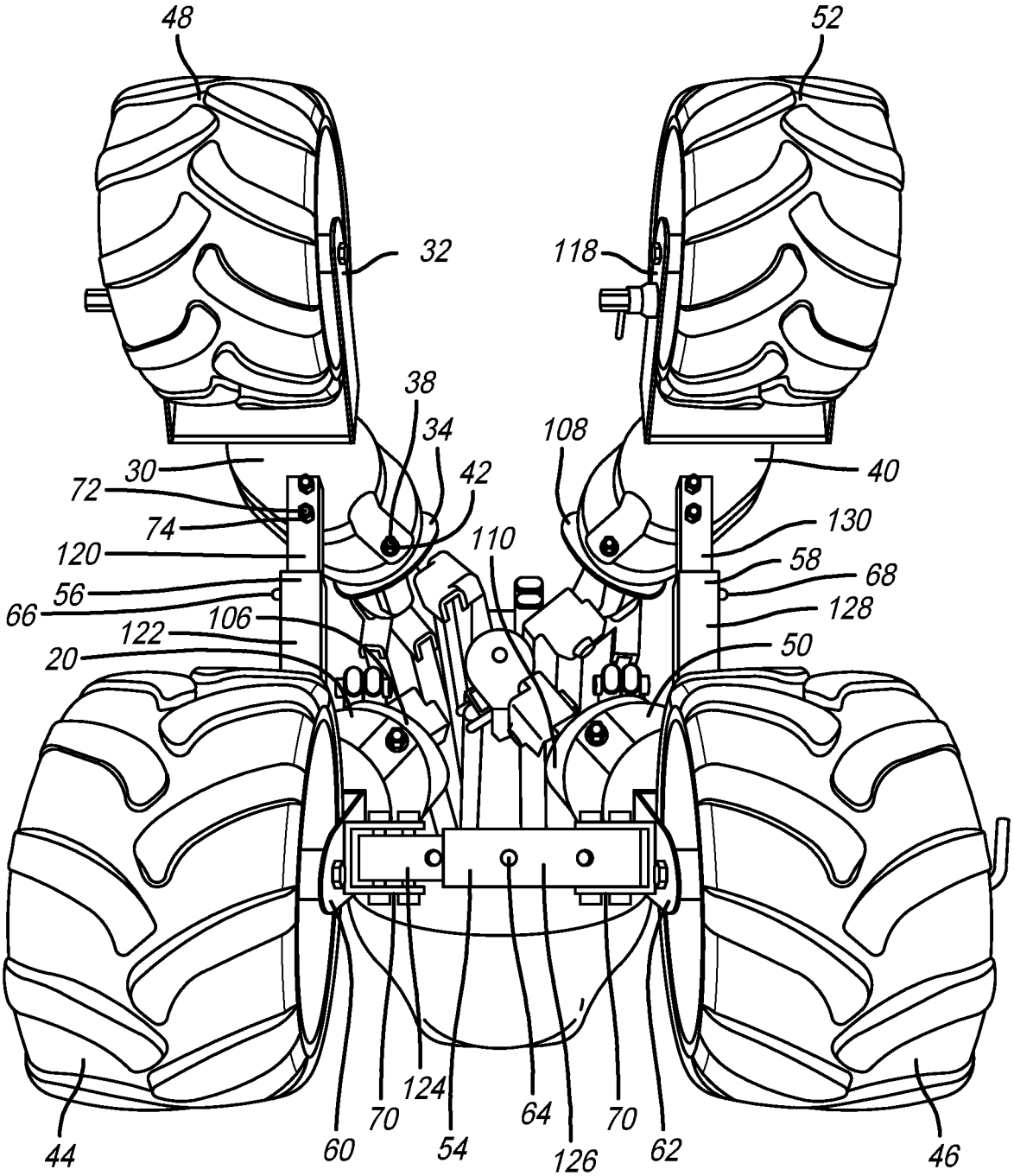
FIG. 3 is an enlarged bottom view of the portable shade system in the collapsed state.

Now referring to FIG. 3, four wheels including a first primary wheel 44, a second primary wheel 46, a first secondary wheel 48, and a second secondary wheel 52.

Figure 5:
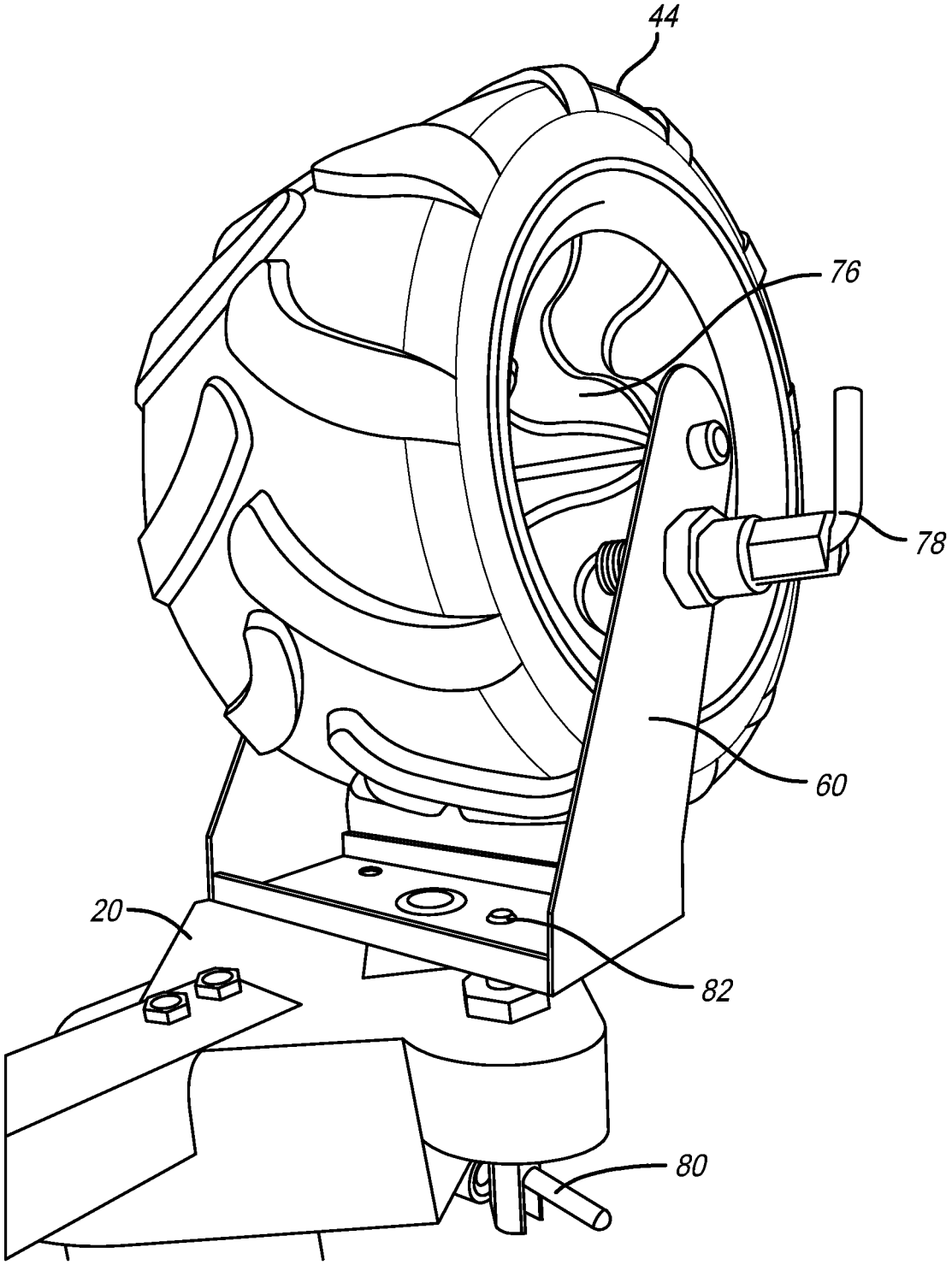

The first primary wheel 44 is carried by a first fork 60 (also refer to FIG. 5). The second primary wheel 46 is carried by a second fork 62. The first secondary wheel 48 is carried by a third fork 32. The second secondary wheel 52 is carried by a fourth fork 118.

The first primary wheel 44 is connected to a first plate 20 (also refer to FIG. 5). The second primary wheel 46 is connected to a second plate 50. The first secondary wheel 48 is connected to a third plate 30, and the second secondary wheel 52 is connected to a fourth plate 40.

Plate 30 is secured to a canopy leg plate 34 using a bolt 38 and a lock nut 42. All four plates 20, 30, 40 and 50 are each connected to canopy leg plates 106, 34, 108 and 110 respectively in this same manner. In an alternate embodiment the plates can be manufactured as an integrated and permanent part of the canopy legs.

Figure 4:
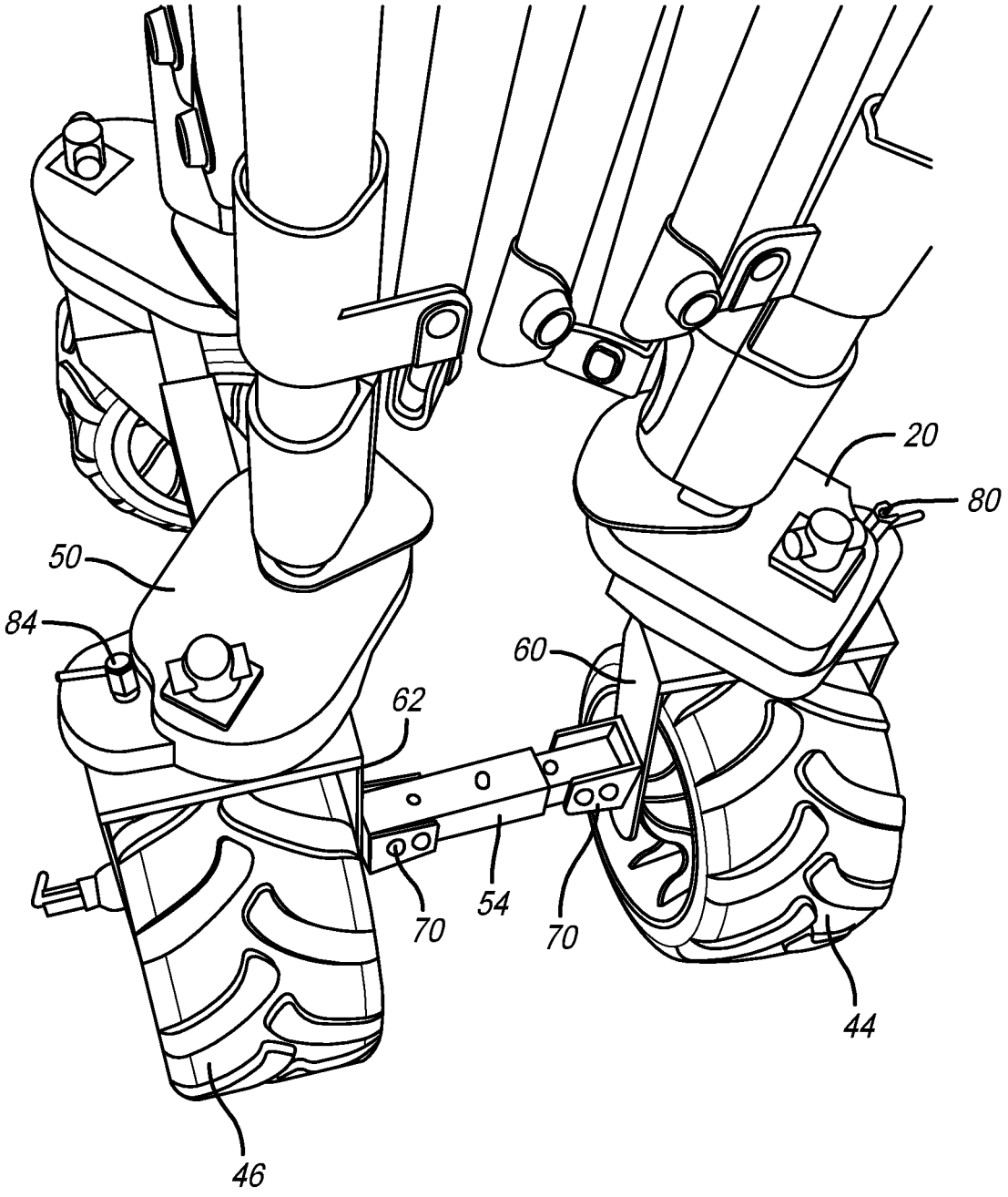
FIG. 4 is a closeup perspective view of the primary breakaway connector and the primary wheels in the collapsed state, which also shows both caster rotation lock mechanisms; and, FIG. 5 is a closeup perspective view of a primary wheel plate showing the brake mechanism as well as how the caster rotation lock mechanism engages with the wheel fork.

Referring also to FIG. 4, a primary breakaway connector 54 is connected between the first fork 60 and second fork 62. The primary breakaway connector 54 is mounted to the first fork 60 and second fork 62 using connector brackets 70.

The primary breakaway connector 54 has a together position (FIGS. 3 and 4) and a separated position (FIG. 1) and is shown here in FIG. 3 in the together position. The primary breakaway connector 54 consists of a cooperating smaller tube 124 and a larger tube 126 which are secured together with a spring button 64. The spring button 64 allows the user to separate the cooperating tubes of the primary breakaway connector 54 or secure them together with a "click."

A first secondary breakaway connector 56 is connected between the first plate 20 and the third plate 30. A second secondary breakaway connector 58 is connected between the second plate 50 and fourth plate 40. Both secondary breakaway connectors 56 and 58 are secured to their respective plates using bolts 72 with lock nuts 74.

Both secondary breakaway connectors 56 and 58 operate in a similar fashion as the primary breakaway connector 54. The first secondary breakaway connector 56 has a cooperating smaller tube 120 and a larger tube 122 and a spring button 66. The second secondary breakaway connector 58 has a cooperating smaller tube 130 and a larger tube 128 and a spring button 68. Both secondary breakaway connectors 56 and 58 have a together position and separated position and are shown here in FIG. 3 in the together position.

Now referring to FIG. 5, which shows first primary wheel 44 and first fork 60 connected to plate 20. First fork 60 and first primary wheel 44 have the ability to caster rotate freely in any direction. Caster rotation is defined as the ability to swivel the wheel to any heading throughout 360 degrees. Caster rotation is a separate and independent motion from the rolling of the wheel.

All wheels of the portable shade system 10 have the ability to caster rotate and have the wheels roll in any direction. Collectively, the unrestricted caster rotation and the rolling of the wheels allow for travel in any direction.

Now referring to FIGS. 4 and 5, a first caster rotation lock mechanism 80 is configured to lock the first fork 60 in a fixed position. A second caster rotation lock mechanism 84 is configured to lock the second fork 62 in a fixed position. Caster rotation lock mechanisms 80 and 84 can be engaged or retracted by the user.

The first and second caster rotation lock mechanisms 80 and 84 each include a pin 82 which engages with the respective fork. Here in FIG. 5 you can see the caster rotation lock mechanism 80 in the engaged position, with pin 82 engaged with fork 60.

When engaged, the caster rotation lock mechanisms 80 and 84 prevent the caster rotation of their respective wheels 44 and 46 but do not prevent the rolling of the wheel. Both caster rotation lock mechanisms 80 and 84 are to be engaged when the portable shade system is in the collapsed state. Caster rotation lock mechanisms 80 and 84 are disengaged while the portable shade system 10 is being deployed as well as while in the deployed state.

Referring to FIGS. 2 and 3, a storage case 22 is shaped and dimensioned to fit over the portable shade system 10 in the collapsed state. The storage case 22 has an open bottom end. The open bottom end is pulled over the canopy like a sock and tightened by zipping a case zipper 88.

The storage case 22 includes a case strap 92 which is configured to run under the first and second secondary connectors 56 and 58, and is secured with a strap latch 94. This makes a secure connection between the storage case 22 and the first and second secondary breakaway connectors 56 and 58 which allows the portable shade system 10 to be pushed or pulled using a case handle 24 without the case coming off. In the preferred embodiment case strap 92 is webbing or similar material with minimal stretch or give.

Now referring to FIGS. 2, 3 and 4, to wheel the portable shade system while in the collapsed state the storage case 22 is to be on and secured with the case strap 92 and strap latch 94. The primary breakaway connector 54 and both secondary breakaway connectors 56 and 58 are to be in the together position, and both castor lock mechanisms 80 and 84 are engaged.

The case handle 24 can then be used to lean the portable shade system 10 back onto the first and second primary wheels 44 and 46 with the first and second secondary wheels 48 and 52 off the ground. The user can then push or pull the portable shade system 10 in this dolly configuration with the case handle 22 being utilized to steer and support it. It is noted that in the collapsed state the portable shade system 10 is wheelable on the first primary wheel 44 and the second primary wheel 46.

Additionally, when on level terrain such as concrete, the portable shade system 10 can be pushed or pulled in the upright state where all four wheels 44, 46, 48, and 52 are on the ground.

Without the support and rigidity of the breakaway connectors 54, 56 and 58 combined with the caster rotation lock mechanisms 80 and 84, the portable shade system 10 will have instability while being wheeled like a dolly. This can lead to an out of balance state where the entire portable shade system 10 may lean and eventually roll over.

Conversely, with the breakaway connectors 54, 56 and 58 in the together positions, and with the caster rotation lock mechanisms 80 and 84 engaged, the portable shade system 10 now has the needed structural support to be wheeled in a balanced and stable state. It is this novel combination that encompasses the essence of the portable shade system 10.

Now referring back to FIG. 1, the portable shade system 10 is shown here in the deployed state. The primary breakaway connector 54 is seen here in the separated position. The first and second secondary breakaway connectors are also in the separated position. We will now walk through the steps of deploying the portable shade system 10 from the collapsed state to the deployed state.

Referring to FIGS. 1, 2, 3 and 4, to deploy the portable shade system 10 from the collapsed state (FIG. 2) the storage case 22 is first removed by unlatching the strap latch 94 and unzipping the case zipper 88. The storage case 22 is then set aside.

Next, both caster rotation lock mechanisms 80 and 84 are disengaged. Then the primary breakaway connector 54 is put into the separated position by pressing the spring button 64 while gently pulling the smaller tube 124 apart from the larger tube 126. Next, both secondary breakaway connectors 56 and 58 are put into the separated position in this same manner.

Now the user can walk one canopy leg outward with its wheel rolling on the ground, which slowly unfolds and expands the portable shade system to its full size. Canopy legs 110, 112, 114 and 116 are then extended vertically to their full height and the portable shade system is now in the deployed state.

To return to the collapsed state, these steps are simply done in reverse order. The user can also easily roll the entire portable shade system 10 while in the deployed state by guiding and walking with a single canopy leg.

Now referring to FIG. 5, each wheel has an independent wheel brake mechanism that can be activated or deactivated by the user. As seen here for the first primary wheel 44, a brake mechanism 78 is mounted to first fork 60 and extends into or retracts from a wheel hub 76. When extended, the brake mechanism 78 prevents the first primary wheel 44 from rolling in either direction.

Locking the wheels via the brake mechanism prevents the portable shade system 10 from unintended rolling when deployed and helps resist the effects of wind. The brake mechanisms can similarly be engaged while the portable shade system 10 is in the collapsed state to also prevent unintended rolling.

Typically, one engaged brake mechanism is sufficient to prevent rolling in the collapsed state and this can be compared to the function of a parking brake. All brake mechanisms should be deactivated when the canopy is being deployed or being returned to the collapsed state.

The portable shade system 10 should not be limited by the above described embodiments, method, and examples, but by all embodiments and methods within the scope and spirit of the invention.

What is claimed is:

1. A portable shade system comprising:

a canopy supported by four canopy legs;

four wheels, one said wheel disposed at the bottom of each said leg;

said four wheels including a first primary wheel, a second primary wheel, a first secondary wheel, and a second secondary wheel;

said first primary wheel carried by a first fork, said second primary wheel carried by a second fork, said first secondary wheel carried by a third fork, and said second secondary wheel carried by a fourth fork;

a primary breakaway connector connected between said first fork and said second fork; and, said primary breakaway connector having a together position and a separated position;

said first primary wheel connected to a first plate, said second primary wheel connected to a second plate, said first secondary wheel connected to a third plate, and, said second secondary wheel connected to a fourth plate;

a first secondary breakaway connector connected between said first plate and said third plate; and, a second secondary breakaway connector connected between said second plate and said fourth plate.

2. The portable shade system according to claim 1, further including:

said primary breakaway connector and said first and second secondary breakaway connector each consisting of cooperating smaller and larger tubes which are secured together with a spring button.

3. The portable shade system according to claim 1, further including:

a deployed state and a collapsed state; and, in said collapsed state, and in said together position of said primary breakaway connector, said portable shade system being wheelable on said first primary wheel and said second primary wheel.

4. The portable shade system according to claim 1, further including:

a first caster rotation lock mechanism which is configured to lock said first fork in a fixed position, and a second caster rotation lock mechanism which is configured to lock said second fork in a fixed position.

5. The portable shade system according to claim 4, further including:

said first and second caster rotation lock mechanism each including a pin.

6. The portable shade system according to claim 1, further including:

said canopy having a collapsed state;

a storage case which is shaped and dimensioned to fit over said canopy and said legs when said portable shade system is in said collapsed state; and, said storage case having an open bottom end.

7. The portable shade system according to claim 1, further including:

said primary breakaway connector and said first and second secondary breakaway connectors each consisting of cooperating smaller and larger tubes which are secured together with a spring button;

a deployed state and a collapsed state;

in said collapsed state, and in said together position of said primary breakaway connector, said portable shade system being wheelable on said first primary wheel and said second primary wheel;

a first caster rotation lock mechanism which is configured to lock said first fork in a fixed position, and a second caster rotation mechanism which is configured to lock said second fork in a fixed position;

said first and second caster rotation lock mechanism each including a pin, said canopy having a collapsed state;

a storage case which is shaped and dimensioned to fit over said canopy and said legs when said portable shade system is in said collapsed state;

said storage case having an open bottom end; and, said storage case including a case strap which is configured to run under said first and second secondary connectors; and be secured with a strap latch.

8. A portable shade system comprising:

a canopy supported by four canopy legs;

four wheels, one said wheel disposed at the bottom of each said leg;

said four wheels including a first primary wheel, a second primary wheel, a first secondary wheel, and a second secondary wheel;

said first primary wheel carried by a first fork, said second primary wheel carried by a second fork, said first secondary wheel carried by a third fork, and said second secondary wheel carried by a fourth fork;

a primary breakaway connector connected between said first fork and said second fork;

said primary breakaway connector having a together position and a separated position;

said canopy having a collapsed state;

a storage case which is shaped and dimensioned to fit over said canopy and said legs when said portable shade system is in said collapsed state;

said storage case having an open bottom end;

said first primary wheel connected to a first plate, said second primary wheel connected to a second plate, said first secondary wheel connected to a third plate, and, said second secondary wheel connected to a fourth plate;

a first secondary breakaway connector connected between said first plate and said third plate;

a second secondary breakaway connector connected between said second plate and said fourth plate; and, said storage case including a case strap which is configured to run under said first and second secondary connectors; and be secured with a strap latch.

* * * * *